US006397433B1

(12) United States Patent
Chen

(10) Patent No.: US 6,397,433 B1
(45) Date of Patent: Jun. 4, 2002

(54) KNUCKLE ASSEMBLY

(76) Inventor: Shih-Ching Chen, P.O. Box No. 6-57 Chung-Ho City, Taipei Hsien 235 (TW)

( * ) Notice: Subject to any disclaimer, the term of this patent is extended or adjusted under 35 U.S.C. 154(b) by 0 days.

(21) Appl. No.: 09/541,509

(22) Filed: Apr. 3, 2000

(51) Int. Cl.[7] ..... E05D 11/10

(52) U.S. Cl. ..... 16/327; 16/324; 403/161; 403/324

(58) Field of Search ..... 403/324, 327, 403/93, 161, 204, 108, 102, 83, 99; 16/324, 327

(56) References Cited

U.S. PATENT DOCUMENTS 4,614,454 A * 9/1986 Kassai ..... 403/62
4,650,388 A * 3/1987 Frioux et al. ..... 414/1
4,893,370 A * 1/1990 Klotz ..... 15/121
5,022,118 A * 6/1991 Wan-Li ..... 16/327
5,056,952 A * 10/1991 Gringer ..... 403/96
5,058,239 A * 10/1991 Lee ..... 16/324
5,265,969 A * 11/1993 Chuang ..... 403/94

* cited by examiner

*Primary Examiner*—Lynne H. Browne
*Assistant Examiner*—John B. Walsh

(57) ABSTRACT

A knuckle assembly includes two mirror-symmetric knuckle ends that are separately connected to two adjacent ends of two long members so that the two long members may be angularly connected together in a bent or an extended position as desired. The two knuckle ends are provided with two fastening pins, one of which may be easily pushed to lock the two knuckle ends in the angularly extended position and the other of which may be easily pushed to unlock the two knuckle ends from the angularly extended position so that the two knuckle ends may be bent relative to each other to occupy only a reduced space.

1 Claim, 3 Drawing Sheets

KNUCKLE ASSEMBLY

BACKGROUND OF THE INVENTION (1) Field Of the Invention

The present invention relates to a knuckle assembly, and more particularly to a knuckle assembly including two mirror-symmetric knuckle ends that are provided with fastening means to quickly lock or unlock the knuckle ends into or from an angularly extended position.

(2) Description of the Prior Art

To meet the requirements of convenience and efficiency, many large-volume articles are so designed that they could be folded to occupy very small space when they are not in use. An example of such large-volume articles is a tent for camping. The tent is usually designed for accommodating more than one person and therefore occupies a very large space when it is fully extended. A tent providing large space is, of course, comfortable for use; it is, however, inconvenient for carry. Therefore, it is desirable to develop means that allow the large-volume articles, such as the tent, to be quickly bent into a small volume for easy carry or firmly locked at an extended position for service.

To achieve such purpose, there is developed a knuckle structure that allows long members of the large-volume articles to be bent into two or three sections when the articles are not in use. For the knuckle structure to mount onto the long members of the large-volume articles, the long members are provided at outer ends with threaded holes. Two threaded holes at the ends of two adjacent long members must first be aligned with each other, and then a screwdriver is usually needed to tighten a bolt through the two aligned holes to lock the two adjacent long members into one unit. In the event a camper forgets to bring such screwdriver with him, it would be difficult to pitch the tent with bare hands.

Therefore, it is the objective of the inventor to develop a knuckle assembly that is directly attached to the members to be angularly connected to one another and does not need any other tools to lock or unlock the knuckle assembly for the members connected by the knuckle assembly to firmly extend for service or quickly bend for storage.

SUMMARY OF THE INVENTION

The knuckle assembly provided according to the present invention includes first and second mirror-symmetric knuckle ends, each of which includes a sleeve portion for receiving an end of one of two long members to be connected together, and a wheel portion associated with a top front of the sleeve portion and located at one side of the top front. Each of the wheel portions is provided along a center line of an exposed circumferential surface with a collar, and each of the sleeve portions is provided at the other side of the top front with a groove that has dimensions for fitly receiving the collar on the other wheel portion. Each of the wheel portions is provided at a predetermined position with an axially extended eccentric hole into which a rivet may be extended to eccentrically connect the first and the second knuckle ends together. Each of the wheel portions is also provided at a predetermined position with a stepped through hole which has a large-diameter end located at an inner side face of the wheel portion and a small-diameter end at an outer side face of the wheel portion. First and second fastening means both having an enlarged head being separately positioned in the stepped holes of the first and the second knuckle ends with the enlarged head seated in the large-diameter end of each stepped hole and a small length of a rod of each the fastening means projected from the small-diameter end. The large-diameter end of the stepped hole on the first knuckle end is provided around an inner surface close to an outer end thereof with a circle of slightly radially inward projected rib. Whereby when the first and the second knuckle ends are pivotally turned relative to each other to a position at which the two stepped holes on the wheel portions are aligned with each other, the second fastening means in the stepped hole of the second knuckle end may be pushed inward to move its enlarged head through the radially projected rib around the stepped hole of the first knuckle end, causing the enlarged head of the second fastening means to be retained in the large-diameter end of the stepped hole on the first knuckle end and thereby locking the first and the second knuckle ends in place, and when the first fastening means is pushed inward to move the enlarged head of the second fastening means back into the large-diameter end of the stepped hole on the second knuckle end, the first and the second knuckle ends are allowed to angularly bend relative to each other.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
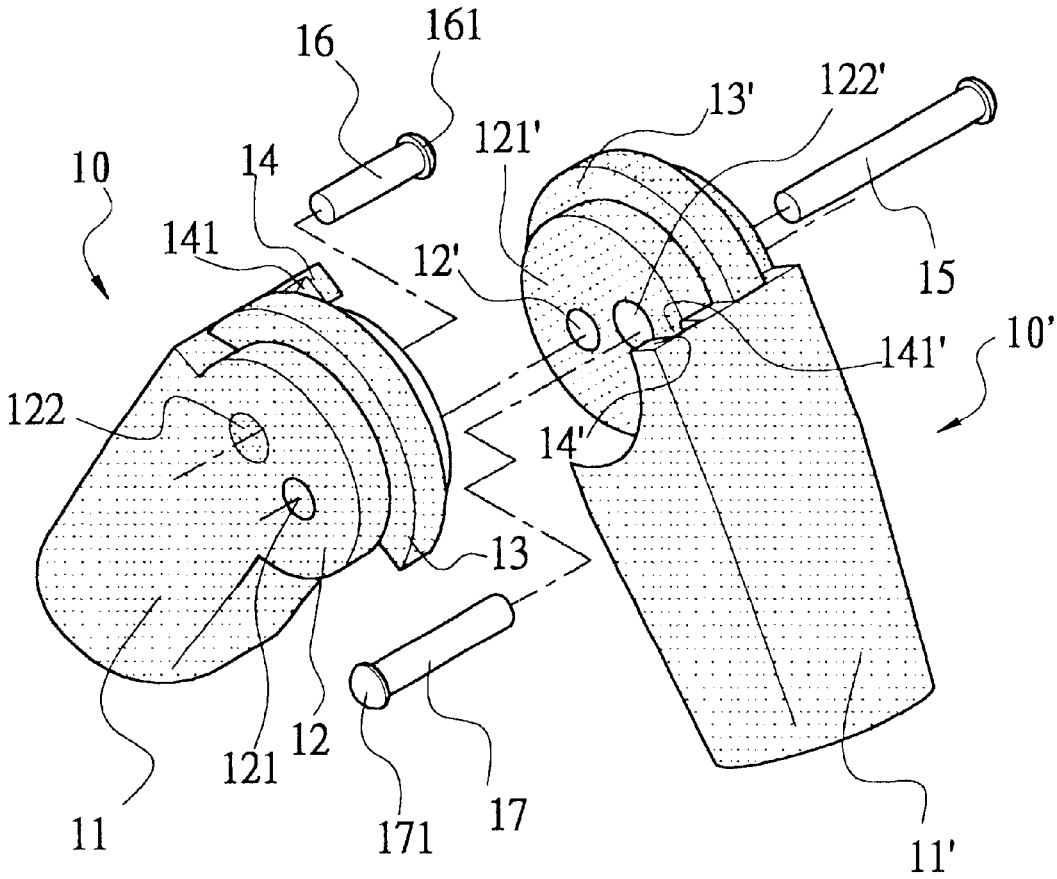
FIG. 1 is an exploded perspective of a knuckle assembly according to the present invention.
Figure 2:
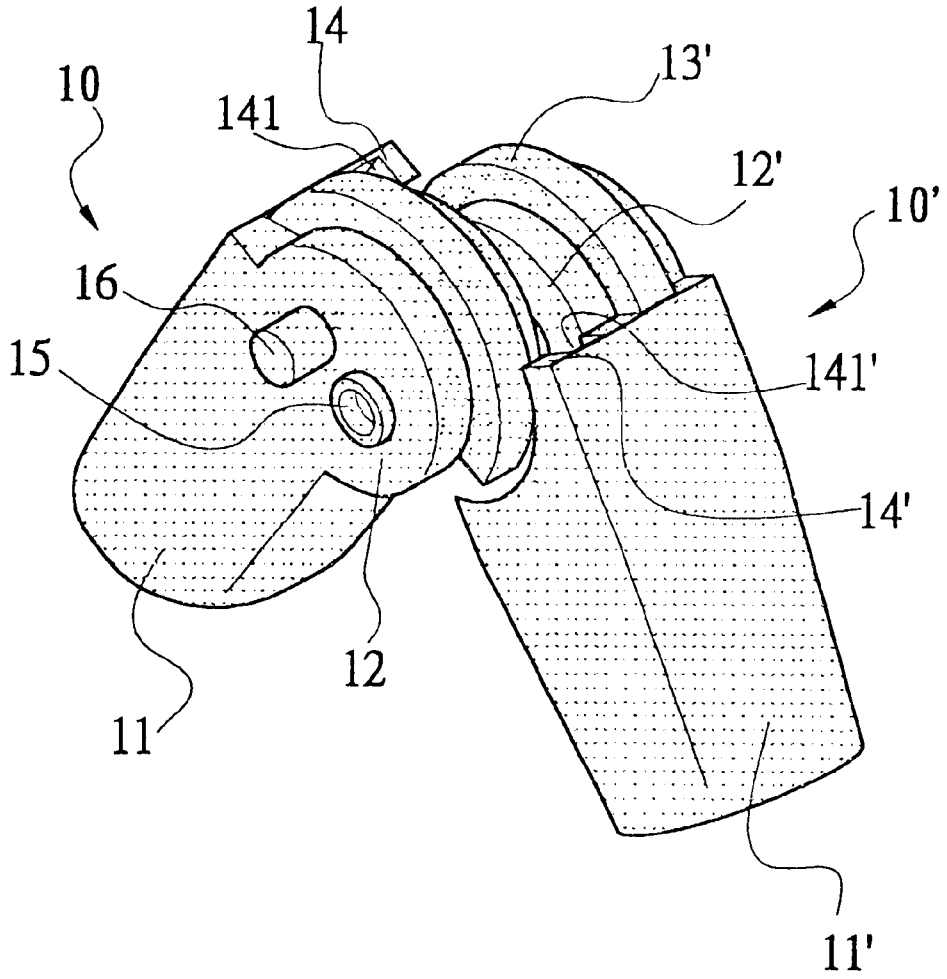
FIG. 2 is an assembled perspective of the knuckle assembly of FIG. 1.
Figure 3:
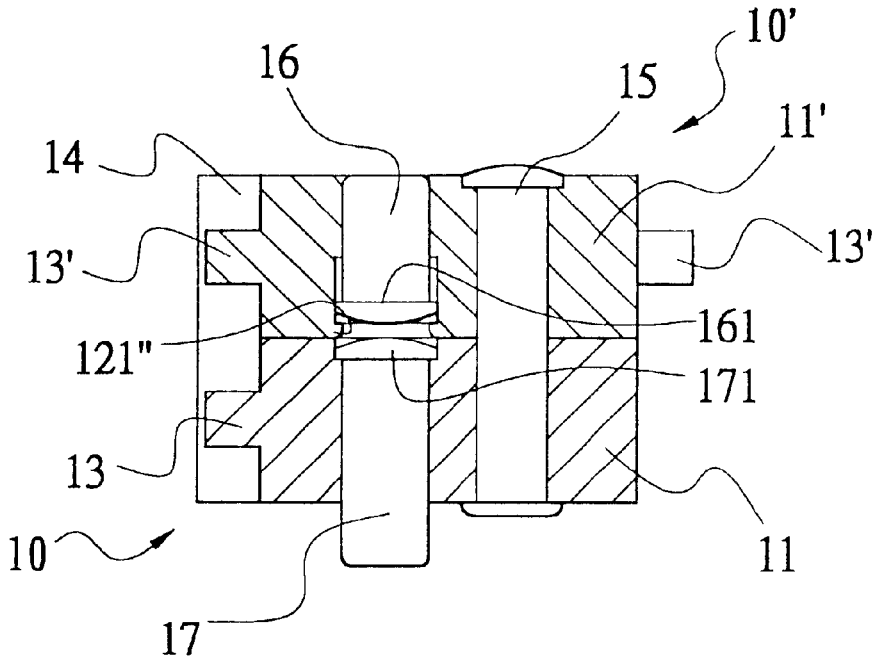
FIG. 3 is a fragmentary sectional view of the knuckle assembly of the present invention in an unlocked position.

Please refer to FIGS. 1 and 2 that are exploded and assembled perspective views, respectively, of a knuckle assembly according to a preferred embodiment of the present invention. As shown, the knuckle assembly mainly includes two mirror-symmetric knuckle ends 10 and 10', each of which further includes a sleeve portion 11, 11' for receiving an end of an element to be joined through the knuckle assembly, and a wheel portion 12, 12' associated with a top front of the sleeve portion 11, 11' to locate at one side of the top front. The wheel portions 12, 12' are provided along a center line of their exposed circumferential surfaces with a collar 13, 13' each. The other side of the top fronts of the sleeve portions 11, 11' provide two thrust walls 14, 14' on which two grooves 141, 141' are formed for fitly receiving the collars 13' and 13, respectively. The wheel portions 12, 12' are correspondingly provided at predetermined positions with a stepped hole 121, 121' each. Please refer to FIG. 3 that is a fragmentary sectional view of the wheel portions 12, 12' of the knuckle ends 10, 10' in the assembled position. As shown, the stepped holes 121, 121' axially extend through the wheel portions 12, 12', respectively, with a large-diameter end located at an inner side face of the wheel portions 12, 12' and a small-diameter end at an outer side face thereof. One of the stepped holes 121, 121', for example, the hole 121 as shown in FIG. 3, is provided around an inner periphery of an outer end of the large-diameter end with a circle of slightly radially inward projected rib 121". The wheel portions 12, 12' are also provided at predetermined positions with axially extended eccentric holes 122, 122' into which a rivet 15 may be extended to eccentrically join the two knuckle ends 10, 10' together. Two fastening means 16, 17 having diametrically enlarged head 161, 171 are respectively extended through the stepped holes 121, 121' with the enlarged head 161, 171 set in and retained to the large-diameter ends and a small length of a rod portion of the fastening means 16, 17 projected from the small-diameter ends. With the enlarged heads 161, 171, the fastening means 16, 17 would not separate from the small-diameter end of the stepped holes 121, 121'.

Figure 4:
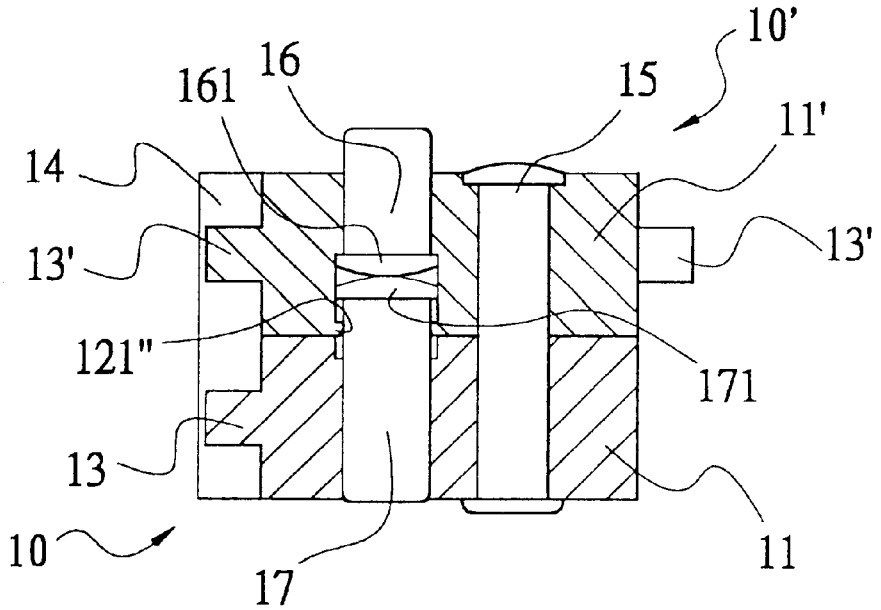
FIG. 4 is a fragmentary sectional view of the same knuckle assembly but in a locked position.

When the two knuckle ends 10, 10' are joined together and bent to a position at which the two stepped holes 121, 121' are aligned with each other, as shown in FIG. 3, it is possible to push the rod of the fastening means 17 projected from the small-diameter end of the stepped hole 121', such that the enlarged head 171 of the fastening means 17 is moved inward to pass through the rib 121" around the large-diameter end of the other stepped hole 121 and be retained in the large-diameter end of the stepped hole 121 by the rib 121", as shown in FIG. 4. At this point, the two wheel portions 12, 12', and accordingly the two knuckle ends 10, 10', are locked to a position not movable relative to each other. To unlock the two knuckle ends 10, 10', simply push the rod of the other fastening means 16 projected from the small-diameter end of the stepped hole 121, such that the enlarged head 161 of the fastening means 16 is moved inward to push against the enlarged head 171 of the fastening means 17 and force the latter to pass the rib 121" again and move out of the large-diameter end of the stepped hole 121. At this point, the wheel portions 12 and 12' are no longer locked together by the fastening means 17 and the knuckle ends 10, 10' are allowed to angularly bend relative to each other.

Since the knuckle assembly of the present invention may be directly attached to two adjacent ends of two long members to be connected together, a user needs not to carry other auxiliary tools to join the knuckle ends with the long members to be connected. Moreover, the two knuckle ends 10, 10' can be conveniently and easily locked in place or unlocked to turn relative to each other simply by inward pushing the projected end of the fastening means 17 or 16. The knuckle assembly of the present invention is therefore very effective and structurally solid for use with items that include folding joints, such as tents.

It is to be understood that the embodiment of the present invention herein described is merely illustrative of the application of the principles of the invention. Reference herein to details of the illustrated embodiment is not intended to limit the scope of the claims, which themselves recite those features regarded as essential to the invention.

What is claimed is:

1. A knuckle assembly comprising first and second mirror-symmetric knuckle ends, each of which including a sleeve portion for receiving an end of one of two long members to be connected together, and a wheel portion associated with a top front of said sleeve portion and located at one side of said top front, each of said wheel portions being provided along a center line of an exposed circumferential surface with a collar, and each of said sleeve portions being provided at the other side of said top front with a groove that has dimensions for fitly receiving said collar of the other said knuckle end in said knuckle assembly; and each of said wheel portions being provided at a predetermined position with an axially extended eccentric hole into which a rivet may be extended to eccentrically connect said first and said second knuckle ends together, each of said wheel portions also being provided at a predetermined position with a stepped through hole which has a large-diameter end located at an inner side face of said wheel portion and a small-diameter end at an outer side face of said wheel portion; first and second fastening means both having an enlarged head being separately positioned in said stepped holes of said first and said second knuckle ends with said enlarged head seated in said large-diameter end of each said stepped hole and a small length of a rod of each said fastening means projected from said small-diameter end; and said large-diameter end of said stepped hole on said first knuckle end being provided around an inner surface close to an outer end thereof with a circle of slightly radially inward projected rib;

whereby when said first and said second knuckle ends are pivotally turned relative to each other to a position at which said two stepped holes on said wheel portions are aligned with each other, said second fastening means in said stepped hole of said second knuckle end may be pushed at said projected end to move said enlarged head of said second fastening means through said radially projected rib around said stepped hole of said first knuckle end, causing said enlarged head of said second fastening means to be retained in said large-diameter end of said stepped hole on said first knuckle end and thereby locking said first and said second knuckle ends in place, and when said first fastening means is pushed at said projected end to move said enlarged head of said second fastening means back into said large-diameter end of said stepped hole on said second knuckle end, said first and said second knuckle ends are allowed to angularly bend relative to each other.

* * * * *